US006387023B1

(12) United States Patent
Liga, Jr.

(10) Patent No.: US 6,387,023 B1
(45) Date of Patent: May 14, 2002

(54) MULTIPLE EFFECT EXERCISING DEVICE

(76) Inventor: Donald Liga, Jr., 7410 West Blvd., Apt. 108, Youngstown, OH (US) 44512

( * ) Notice: Subject to any disclaimer, the term of this patent is extended or adjusted under 35 U.S.C. 154(b) by 0 days.

(21) Appl. No.: 09/579,229

(22) Filed: May 30, 2000

(51) Int. Cl.[7] ..... A63B 21/04

(52) U.S. Cl. ..... 482/130; 482/148; 482/129; 482/126; 482/121

(58) Field of Search ..... 482/121–123, 482/126, 129, 130, 124–125, 148

(56) References Cited

U.S. PATENT DOCUMENTS 4,072,309 A * 2/1978 Wilson ..... 482/130
4,492,375 A * 1/1985 Connelly ..... 482/138
4,582,320 A * 4/1986 Shaw ..... 482/130
5,201,694 A * 4/1993 Zappel ..... 482/133
5,387,171 A * 2/1995 Casey et al. ..... 482/130
5,393,286 A * 2/1995 Cheng ..... 482/130
5,486,150 A * 1/1996 Randolph ..... 482/133
5,547,442 A * 8/1996 Carballosa et al. ..... 482/46
5,769,757 A * 6/1998 Fulks ..... 482/45
6,234,941 B1 * 5/2001 Chu ..... 482/100

* cited by examiner

*Primary Examiner*—Michael A. Brown
*Assistant Examiner*—Lori Baker Amerson
(74) *Attorney, Agent, or Firm*—Harpman & Harpman

(57) ABSTRACT

An exercising machine for developing multiple muscle groups by combining three distinct exercise elements into a single attenuated movement. The device includes a bifurcated support base having an upstanding support post. A pair of bipolar pivoting arms extending from a central support bracket pivotally secured to support post. Axially resistant handgrips extending from the respective pivoted arms. Resilient elements interconnecting the bipolar arms, support brackets and support posts. A bench being positioned for user engagement in spaced relation to said respective handgrips.

4 Claims, 6 Drawing Sheets

MULTIPLE EFFECT EXERCISING DEVICE

BACKGROUND OF THE INVENTION

1. Technical Field

The present invention relates to exercising machines in which repetitive resistant movement by the user exercises different parts of the body.

2. Description of Prior Art

Prior art devices of this type have relied on a variety of different structural configurations adapted to exercise various muscle groups of the human body. Typically, exercise machines are developed and designed for specific purposes while others provide for multiple exercises on the same machine.

Historically, weights have been used to provide resistance to muscle movements while other devices use resilient bands, springs, etc.

In U.S. Pat. No. 5,393,286 an exercise machine is disclosed having multiple exercising elements both for the legs and the arms of the user on independent movement planes.

U.S. Pat. No. 5,547,442 is directed to an exercising device which imparts multiple manipulations and maneuvers during exercise. Pivoted arms extend from the main support frame having handgrips thereon. This device provides resistance for the user's arms in both directions.

U.S. Pat. No. 5,769,757 discloses a method and apparatus for exercise with forced pronation or supination movement of the hands and arms in conjunction with the novel range of motion. A sub-frame supports a set of two pivoting levers each of which has incrementally adjustable weights to provide resistance.

SUMMARY OF THE INVENTION

The present invention is directed towards exercising machines which have multiple function within a single apparatus. According to the present invention, the exercising machine comprises a base, an upstanding support post with an arm support assembly pivotally secured thereto. The arm support assembly has engagement arms with hand grip elements so that the user can grip the respective arms while lying on a bench positioned thereunder and provide for a three part exercise in which the assembly is raised vertically, the hands are twisted under resistance and simultaneously the arms are drawn together under resistance.

DESCRIPTION OF THE PREFERRED EMBODIMENT

Figure 1:
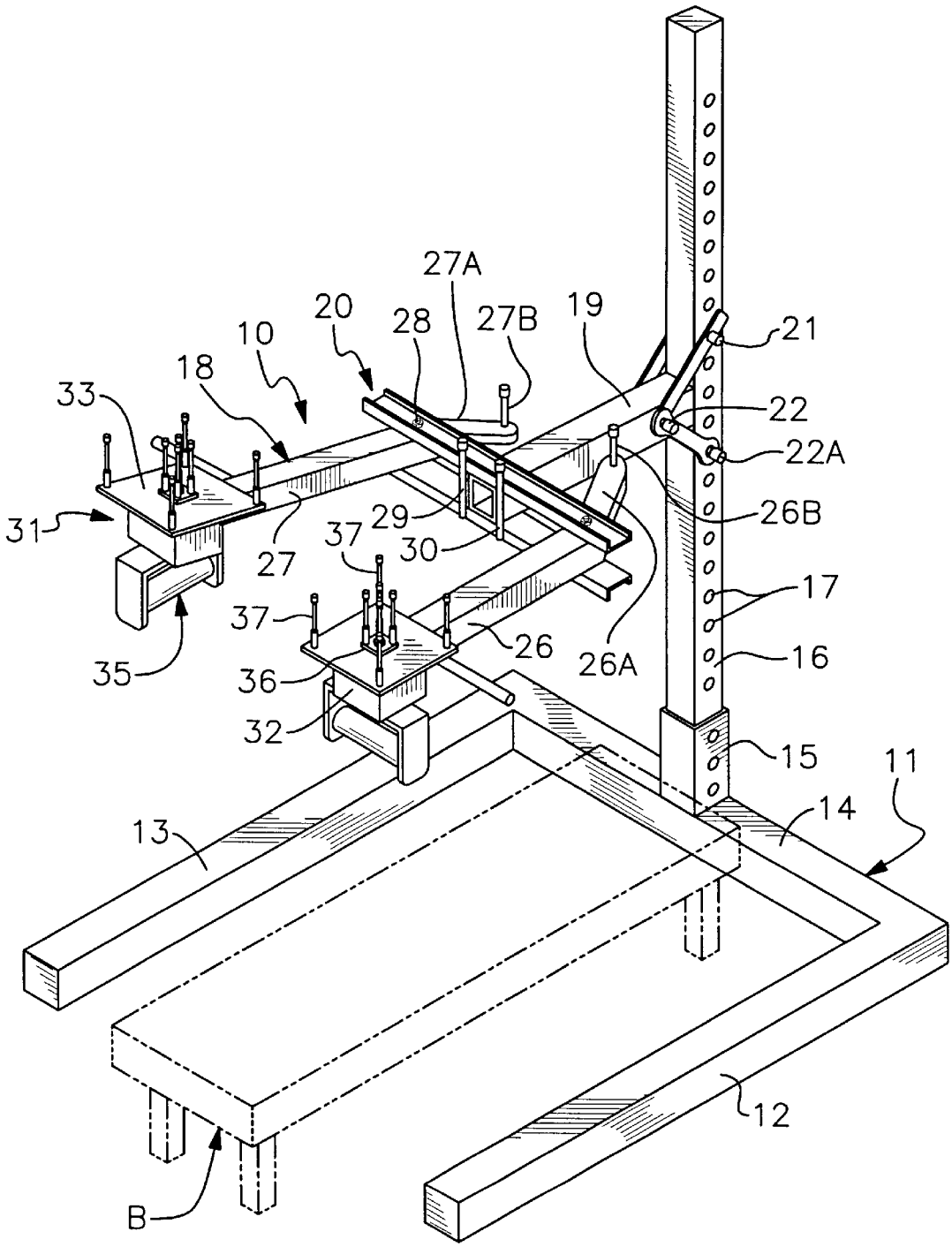
FIG. 1 is an isometric view of the exercising device of the invention.

Referring now to FIG. 1 of the drawings, an exercise device 10 can be seen having a U-shaped base 11 defined by a pair of spaced parallel tubular members 12 and 13 interconnected by a cross member 14. An upstanding engagement socket 15 extends from the cross member 14. A tubular support post 16 is registerable within and extends from the engagement socket 15. The post 16 has a plurality of longitudinally spaced apertures at 17 within. The framework as hereinbefore described provides a structure by which supports the mechanism of the present invention.

Figure 2:
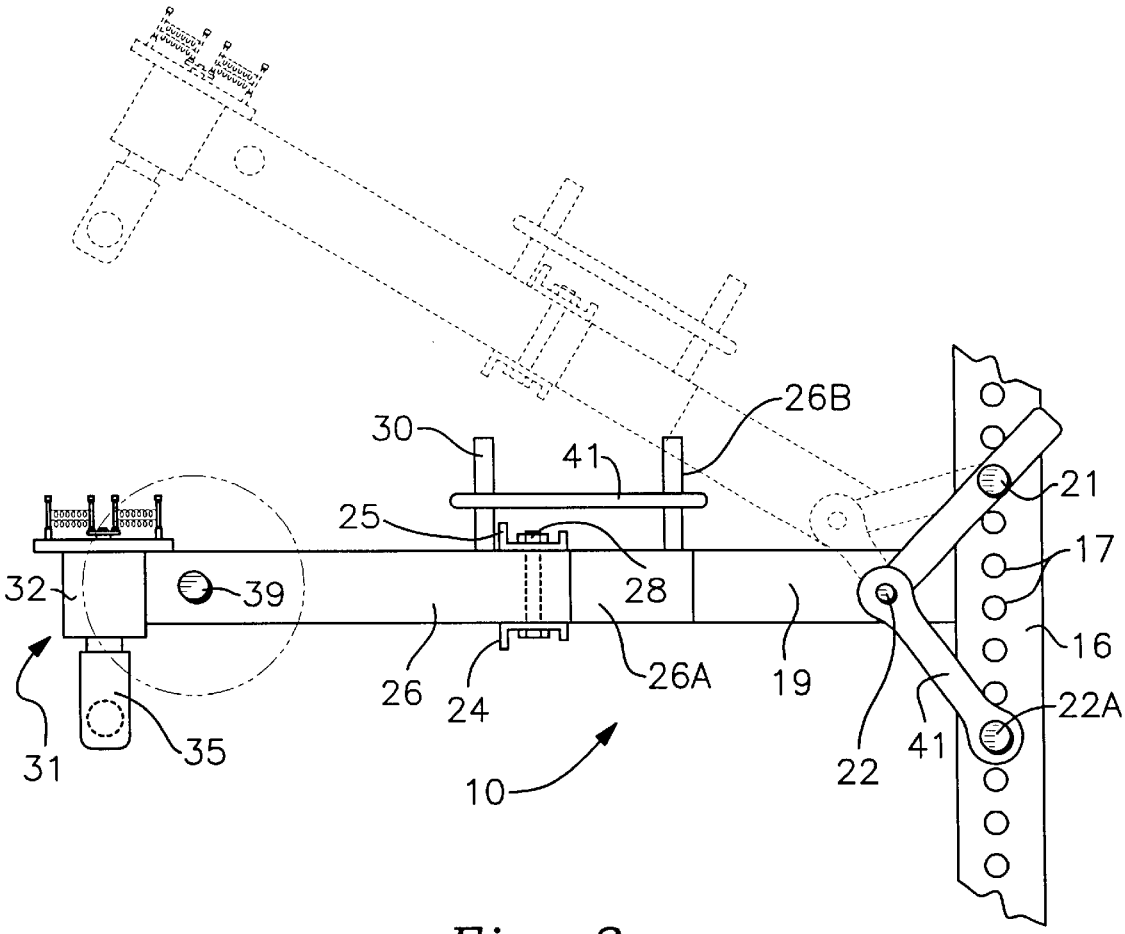
FIG. 2 is a partial side elevational view of the exercising device.

An arm assembly 18 of the present invention has a central support tube 19 with an arm mounting bracket 20 on one end thereof. The central support tube 19 is in turn pivotally secured to the support post 16 by pairs of interconnected pivot pin pairs 21 and 22, best seen in FIGS. 2 and 3 of the drawings. The pivot pin pairs 21 and 22 are connected by a respective apertured links 23. It will be evident from the above description that the relative height of the arm assembly 18 can be adjusted vertically by repositioning the pivot pin pairs 21 on the upstanding support posts 16.

The arm mounting bracket 20 extends transversely across the end of the central support tube 19 and is comprised of a pair of vertically spaced horizontally disposed apertured angle irons 24 and 25. The pair of pivoted lever arms 26 and 27 are pivotally secured inwardly of the respective ends of the arm engagement bracket 20 by pivot bolts 28. Each of the pivot lever arms 26 and 27 have an angular extension at 26A and 27A with an upstanding band engagement rods 26B and 27B. A secondary pair of band engagement rods 29 and 30 extend vertically from the engagement arm bracket 18 adjacent the intersection of the hereinbefore-described central support tub 19.

The pivoted lever arms 26 and 27 extend angularly outwardly from the pivot bolts 28 to respective hand grips assemblies 31 secured on their distal ends.

Figure 5:
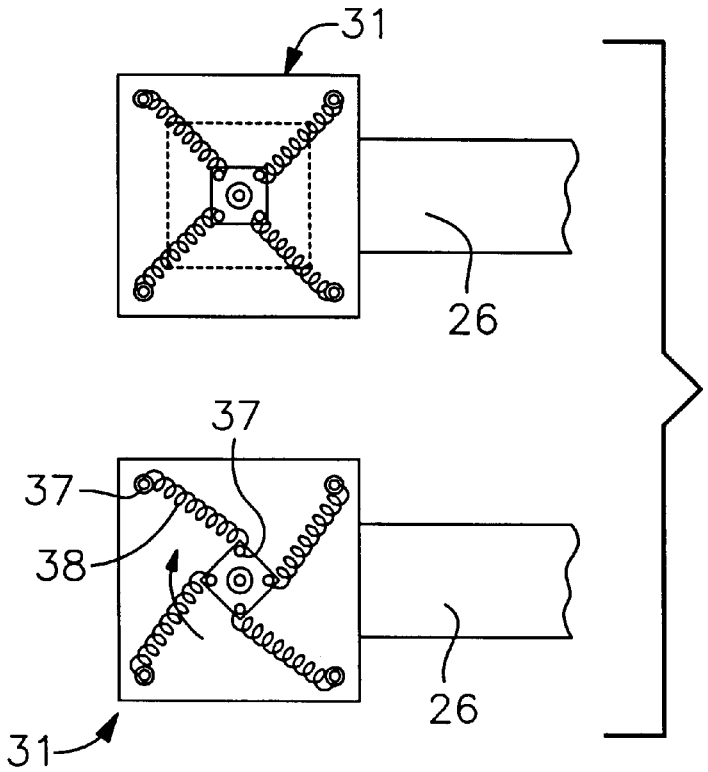
FIG. 5 is an enlarged top plan view of the resistance handgrip assembly in its rest and energized positions respectively.
Figure 6:
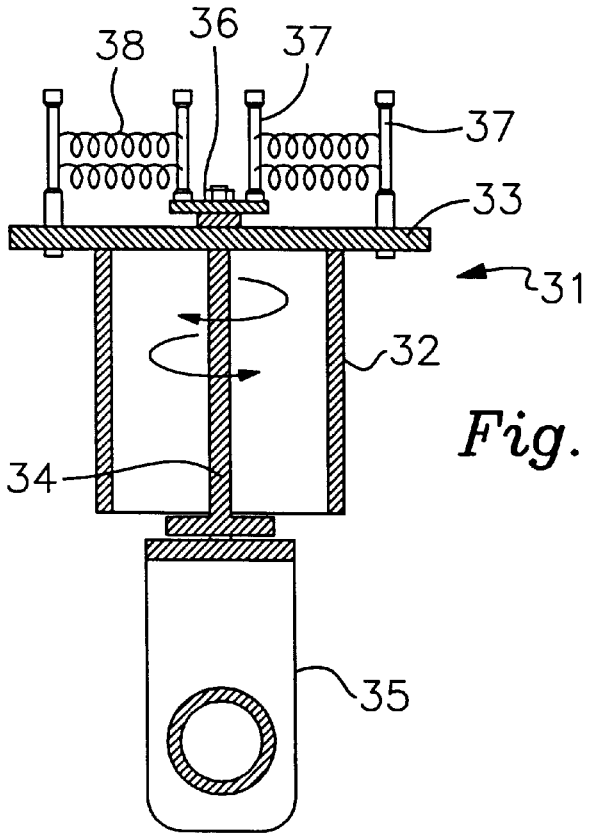
FIG. 6 is a cross-sectional view of the hand grip assembly.

Referring now to FIGS. 5A, 5B and 6 of the drawings, it will be seen that each of the handgrip assemblies 31 includes a fixed tubular support brace 32 with an upper spring mounting plate 33 extending thereacross. A central shaft 34 extends through the mounting plate 33 with a handgrip 35 secured thereto below the tubular support brace 32. A spring engagement plate 36 is secured to the shaft 34's opposite end in spaced relation to the spring mounting plate 34. Multiple spring mounting posts 37 extend from the respective perimeter corners of the spring mounting plate 33 and spring engagement plate 36 with pairs of spring elements 38 secured therebetween as best seen in FIG. 5A of the drawings. It will be evident that by rotation of the hand grips 35 the multiple spring elements 38 will be engaged imparting progressive spring resistance to the hand grips 35 during movement as illustrated in FIGS. 5A and 5B of the drawings.

Weight rods 39 extend at right angles from the respective lever arms 26 and 27 adjacent the hereinbefore-described handgrip assemblies 31. The weight rods 39 provide the selective progressive placement of free weights 40 shown in broken lines thereon for additional lifting resistance to the lever arms 26 and 27 of the assembly. Resilient bands 41 are removably positioned between the pivot pin pairs 22 and respective restraining pins 22A selectively engaged on the main support post 16 in spaced relation to the hereinbefore described pivot pin pairs 21 as will be best seen in FIG. 2 of the drawings. The resilient bands 41 impart resistance (upon elongation) to the movement of the central support tube 19 and arm assembly 18 from a first position shown in solid lines to a second position illustrated in broken lines.

Figure 3:
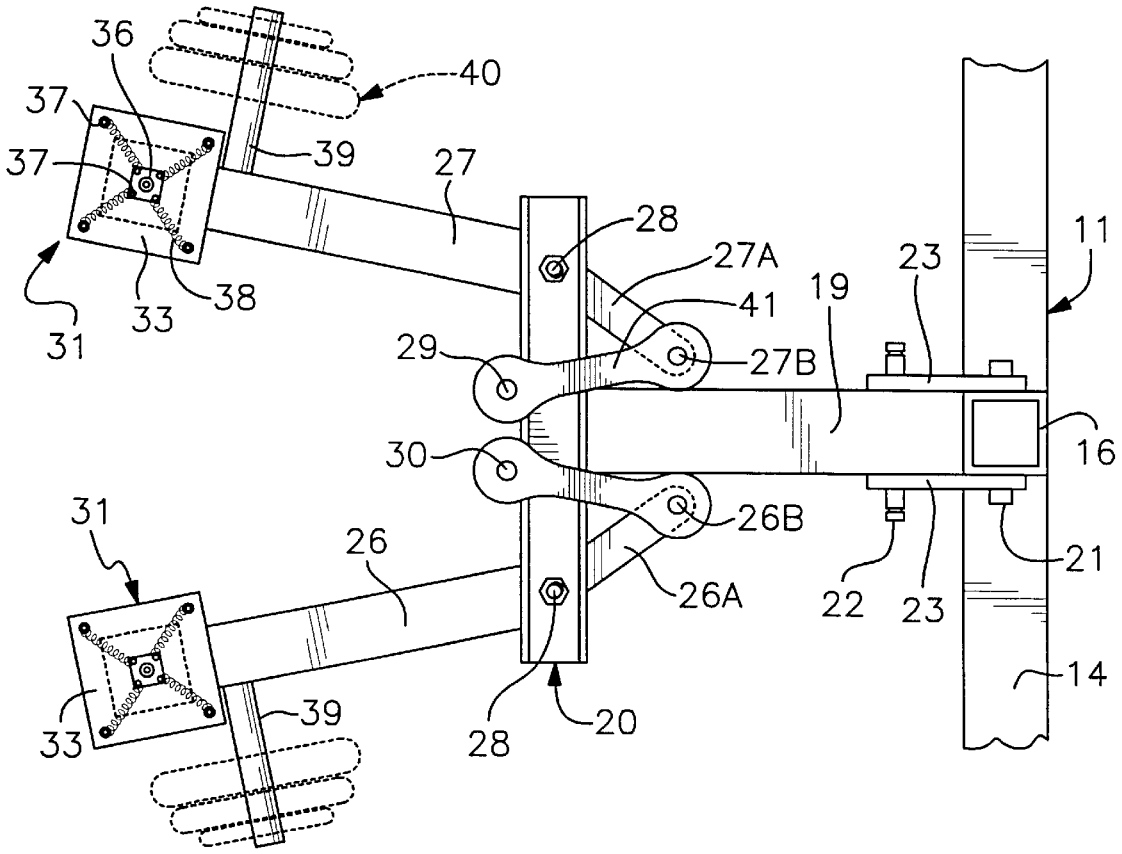
FIG. 3 is a top plan view of the exercising device as seen in FIG. 2.

Additionally, resilient bands 41 are also used to interengage between the upstanding band engagement rods 29 and 27B and 30 and 26B, best seen in FIG. 3 of the drawings.

Figure 4:
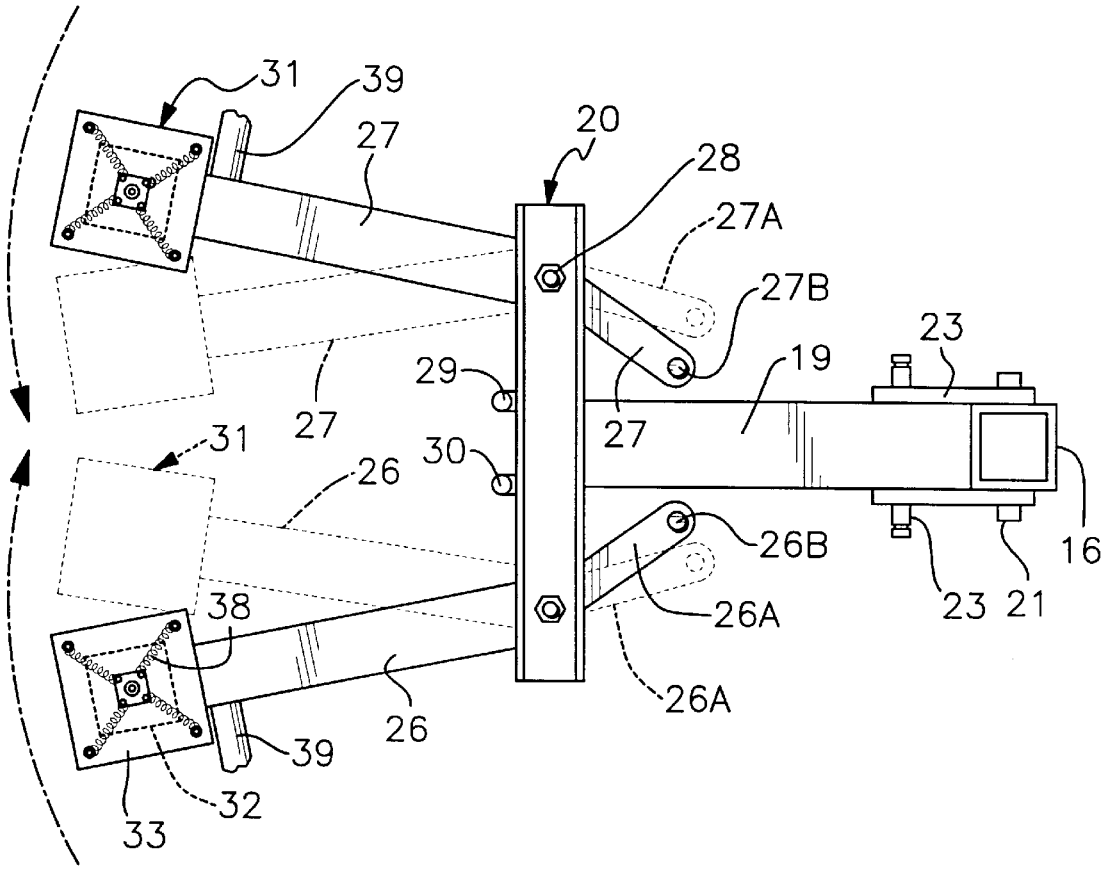
FIG. 4 is an illustrative top plan view with arm movement range indicated in dotted lines.

The resilient bands 41 so used provide lateral kinetic resistance to the respective lever arms 26 and 27 as they are drawn inwardly towards one another as indicated in dotted lines of FIG. 4 of the drawings.

In use, a bench B shown in broken lines is positioned within the U-shaped base 11 so that the user (not shown) would lay prone on the bench B facing the arm assembly 20 as is typical in many exercising venues.

The sequence of exercises accomplished by the exercising device of the invention is as follows. The user thus positioned on the bench B grips the hand grips 35 and pushes upwardly against the resilient bands 41 and auxiliary free weights 40 if used while simultaneously twisting hand grips 35 against the spring resistance while drawing the arms towards one another against the resilient bands 41 thereby imparting an effective three exercising elements within one set of repeatable movements.

As noted, the lifting effort i.e. resistance afforded to the user against the arm assembly 20 can be increased by the placement of the auxiliary weights 40 as hereinbefore described. The exercise can thus be repeated providing a unique work out to the user in a single exercising station.

Referring now to FIGS. 5 and 6 of the drawings, the spring resistance of the hand grip 31 can be adjusted by adding or deleting springs 38 or replacing same with higher rated springs as will be well understood by those skilled in the art.

Figure 7:
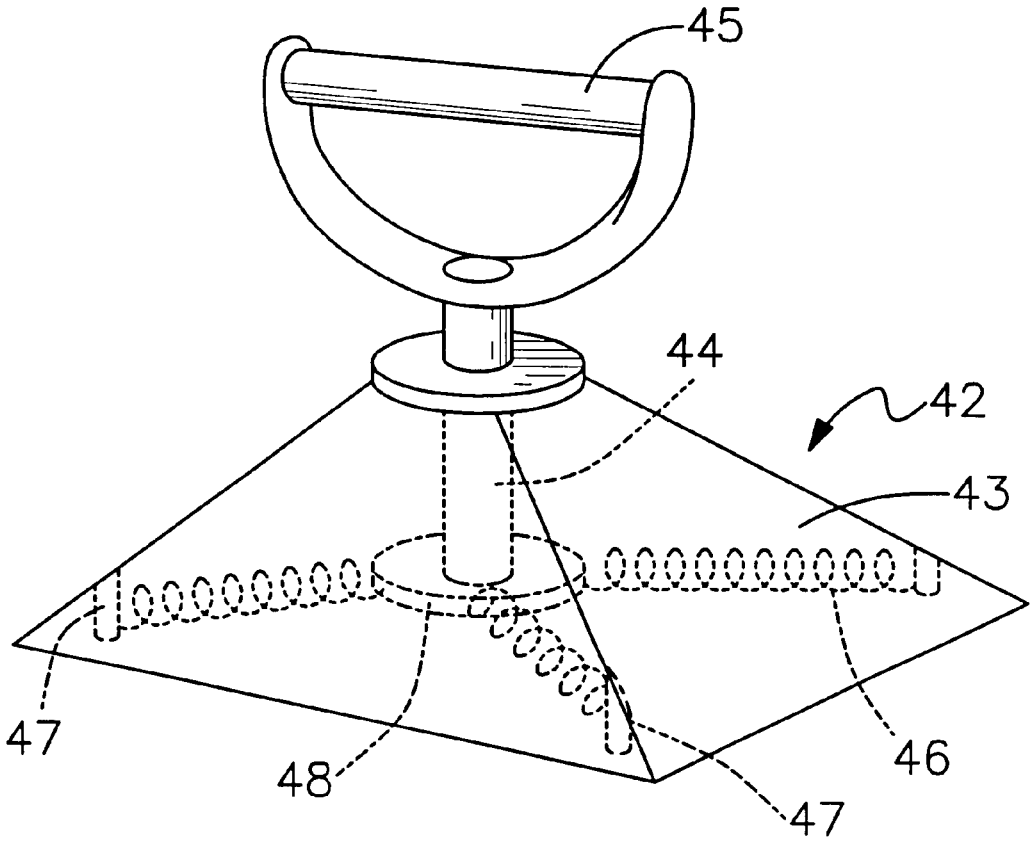
FIG. 7 is an enlarged perspective view of an alternate form of the hand resistant handgrip portion of the invention positioned for independent use.

Referring now to FIG. 7 of the drawings, an alternate hand grip assembly 42 can be seen having a support housing 43 with a central rod 44 extending therefrom with hand grip fittings 45 secured to the rod's free ends. A plurality of spring members 46 extend from an engagement post 47 to the inner surface housing 43 and respective engagement plate 48 on the rod 44 within the housing. It will be seen that upon rotation of the hand grip 45 spring resistance will be imparted thereto.

In this alternate form the handgrip assemblies 42 are to be used by placing the housing 43 directly on the ground with the hand grips 45 facing upwardly. The user (not shown) positions themselves over the hand grips engaging same in a "push-up position" and performs push-up exercises while twisting the respective grips 45 in either rotational direction. Such an exercise imparts not only the typical arm improvement, but also the added benefit of the twisting motion as the exercise is performed.

It will therefore be apparent to those skilled in the art that various changes and modifications may be made thereto without departing from the spirit of the invention.

Therefore I claim:

1. An exercising machine comprising, a main support base frame having an upstanding support post, a central support element pivotally secured to and extending from said support post, said central support element having an arm mounting bracket secured thereto, a pair of lever arms pivotally secured to and extending from said arm mounting bracket, hand grip assemblies on the distal end of said respective lever arms, said hand grip assemblies, a support housing with a central support engagement rod extending therefrom, a hand grip fitting secured to said engagement rod in spaced relation to said housing, a spring engagement fitting on said rod within said housing, a plurality of spring elements extending from said spring engagement fitting to engagement posts on said housing.

2. The exercise machine set forth in claim 1 wherein said main support base frame is U-shaped.

3. The exercise machine set forth in claim 1 wherein said lever arms have angularly offset terminal arm extensions.

4. The exercise machine set forth in claim 1 wherein said resilient resistant means on said lever arms and said central support element comprise elastic bands.

* * * * *